US007362993B2

(12) United States Patent
Takahashi

(10) Patent No.: US 7,362,993 B2
(45) Date of Patent: Apr. 22, 2008

(54) TRANSFER DEVICE AND IMAGE FORMING APPARATUS

(75) Inventor: Mitsuru Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 324 days.

(21) Appl. No.: 11/118,409

(22) Filed: May 2, 2005

(65) Prior Publication Data

US 2005/0265755 A1 Dec. 1, 2005

(30) Foreign Application Priority Data

May 26, 2004 (JP) ..... 2004-156608

(51) Int. Cl.
*G03G 15/01* (2006.01)

(52) U.S. Cl. ..... 399/302; 399/167; 399/308

(58) Field of Classification Search ..... 399/107, 399/121, 162, 167, 297, 299, 301, 302, 308; 492/56

See application file for complete search history.

(56) References Cited

U.S. PATENT DOCUMENTS

| | | | | |
|---|---|---|---|---|
| 6,198,889 | B1 * | 3/2001 | Yu et al. | 399/75 |
| 6,834,174 | B2 | 12/2004 | Imaizumi et al. | |
| 6,898,398 | B2 | 5/2005 | Omata et al. | |
| 6,954,606 | B2 * | 10/2005 | Barnes et al. | 399/313 |
| 7,020,412 | B2 * | 3/2006 | Yoshida | 399/94 |
| 2004/0131386 | A1 * | 7/2004 | Koide | 399/167 |
| 2004/0208672 | A1 * | 10/2004 | Igarashi | 399/167 |
| 2005/0265755 | A1 | 12/2005 | Takahashi | |

FOREIGN PATENT DOCUMENTS

| | | |
|---|---|---|
| JP | 11-202700 | 7/1999 |
| JP | 2000-94734 | 4/2000 |
| JP | 2001-318538 | 11/2001 |
| JP | 2002-139893 | 5/2002 |
| JP | 2002-251079 | 9/2002 |
| JP | 2002-287459 | 10/2002 |
| JP | 2003-330230 | 11/2003 |

OTHER PUBLICATIONS

U.S. Appl. No. 11/471,599, filed Jun. 21, 2006, Saeki et al.
U.S. Appl. No. 11/608,008, filed Dec. 7, 2006, Katoh et al.

* cited by examiner

*Primary Examiner*—Hoan Tran
(74) *Attorney, Agent, or Firm*—Oblon, Spivak, McClelland, Maier & Neustadt, P.C.

(57) ABSTRACT

In a transfer device, a driving roller that rotationally drives a belt member satisfies a condition "$(R_2-R_1)\pi\times(s-1)\times p/(R_1\times\pi\times 2)\leqq 0.15$ millimeter", where $R_1$ is a diameter of the driving roller under an environment of a minimum temperature and a minimum moisture in a use environment range designed, $R_2$ is a diameter of the driving roller under an environment of a maximum temperature and a maximum moisture in the use environment range at design, p is an arrangement pitch of the transfer units, s is a total number of the transfer units, and $\pi$ is the circle ratio pi.

9 Claims, 3 Drawing Sheets

TRANSFER DEVICE AND IMAGE FORMING APPARATUS

CROSS-REFERENCE TO RELATED APPLICATIONS

The present document incorporates by reference the entire contents of Japanese priority document, 2004-156608 filed in Japan on May 26, 2004.

BACKGROUND OF THE INVENTION

1) Field of the Invention

The present invention relates to a transfer device and an image forming apparatus that superimpose a plurality of visible images on a surface of a belt member, which is moved endlessly while being spanned by spanning members, to form a multi-superimposed image.

2) Description of the Related Art

In conventional image forming apparatuses, a plurality of monochrome toner images, which are visible images, are superimposed on an endlessly moving belt member (a belt surface, a sheet held thereon, or the like) to form a multi-color toner image, which is a multi-superimposed image. In such an image forming apparatus, a transfer system or a direct recording system is adopted as a unit that superimposes the monochrome toner images on the belt member.

Japanese Patent Application Laid-Open No. 2001-318538 discloses an image forming apparatus in which monochrome toner images are superimposed using the image superimposing unit adopting the transfer system, namely, a transfer device. In this image forming apparatus, monochrome toner images with colors different from one another are formed on a plurality of photoconductors placed opposite an intermediate transfer belt, which is a belt member, by respective electro-photograhic processes. The monochrome toner images are then sequentially superimposed and transferred onto the endlessly moving intermediate transfer belt.

Japanese Patent Application Laid-Open No. 2000-94734 discloses an image forming apparatus in which monochrome toner images are superimposed using the image superimposing unit adopting the direct recording system. In this image forming apparatus, toner images are formed without using such an electro-photograhic process; instead, electrostatic latent images are developed using the toner. Specifically, the image forming apparatus includes a plurality of image forming units, each of which can directly record a toner image on an intermediate recording belt serving as a belt member, by spattering toner group in a dotting manner through any of plural holes formed in an electronic substrate. Monochrome toner images of different colors are sequentially superimposed on one another, and are thereby recorded to an endlessly moving intermediate transfer belt at respective positions opposite the image forming units.

In each of the above image forming apparatuses, an endless moving velocity of the belt member depends on a circumferential velocity of a driving roller, which is rotationally driven while holding a spanned belt. That is, when a diameter of the driving roller changes due to an environmental fluctuation such as temperature or moisture, the circumferential velocity of the driving roller also changes accordingly. Further, the endless moving velocity of the belt member also changes depending on the change in the circumferential velocity of the driving roller. Thus, when the endless moving velocity of the belt member changes in this manner, the position where the respective color toner images are superimposed deviates. For example, if the endless moving velocity is stabilized at a velocity faster than an ideal value (uniform movement), when formation of respective color toner images starts at the same timing as the ideal value, toner images are position-deviated according to a sequential superimposing order thereof toward further downstream side in a moving direction of the belt. Superimposing deviation occurs due to the positional deviation. Alternately, for example, if the endless moving velocity is stabilized at a velocity slower than the ideal value (uniform movement), when formation of respective color tone images starts at the same timing as the ideal value, toner images are position-deviated according to a sequential superimposing order thereof toward further upstream side in the moving direction of the belt. In particular, when a roller, covered on the surface with elastic material such as rubber, is used as the driving roller for suppressing slippage between the driving roller and the belt member, the superimposing deviation may occur easily because thickness of the elastic material easily changes according to environmental fluctuation.

On the other hand, Japanese Patent Application Laid-Open No. 2002-287459 discloses an image forming apparatus that, based on pitch deviation of reference toner images for respective colors transferred on an intermediate transfer belt, periodically performs deviation correcting control for correcting light-writing timings to respective photoconductors. In the deviation correcting control, reference toner images for respective colors are theoretically formed on respective photoconductors at timings at which respective color toner images can be arranged and transferred on the surface of the intermediate transfer belt at equal intervals. The reference toner images for respective colors actually transferred on the surface of the intermediate transfer belt are detected by an optical sensor, and intervals of the reference toner images for respective colors are captured based on the detected time intervals. When the reference toner images for respective colors are not formed at equal intervals due to a velocity change of the intermediate transfer belt, light-writing timings to the respective photoconductors are corrected such that the reference toner images for respective colors are formed at equal intervals. Executing such a deviation correcting control periodically suppresses the superimposing deviation among respective color toner images occurring due to the diameter change of the driving roller according to an environmental fluctuation.

However, to suppress superimposing deviation among respective color toner images due to the diameter change of the driving roller according to the environmental fluctuation based on the deviation correcting control, the deviation correcting control needs to be performed quite frequently, for example, every time the environmental fluctuations exceed a threshold. This results in an increase in a frequency of the user rejecting a print start instruction, which is inconvenient for the user.

SUMMARY OF THE INVENTION

It is an object of the present invention to at least solve the problems in the conventional technology.

According to an aspect of the present invention, a transfer device includes a belt device that moves a belt member endlessly by rotating a driving roller while the belt member is spanned by spanning members, wherein the driving roller is one of a plurality of the spanning members; and a plurality of transfer units that transfer in a superimposing manner, visible images carried on corresponding image carriers, onto any one of an obverse face of the belt member and a recording member held on the belt member, wherein the transfer units are arranged inside a loop of the belt member, each the transfer unit being placed opposite to one of a plurality of the image carriers that are arranged equidistantly outside the loop of the belt member, and at a pitch identical to a pitch at which the image carriers are arranged. The driving roller satisfies a condition "$(R4-R3)\pi\times(st-1)\times pt/(R3\times\pi\times2)\leqq0.15$ millimeter", where R3 is a diameter of the driving roller under an environment of minimum temperature and minimum moisture in a use environment range designed, R4 is a diameter of the driving roller under an environment of maximum temperature and maximum moisture in the use environment range designed, pt is an arrangement pitch of the transfer units, st is a total number of the transfer units, and $\pi$ is the circle ratio pi.

According to another aspect of the present invention, an image forming apparatus includes a first belt device that moves a first belt member endlessly by rotating a first driving roller while the first belt member is spanned by first spanning members, wherein the first driving roller is one of a plurality of the first spanning members; and a plurality of image superimposing units that superimpose visible images onto any one of an obverse face of the first belt member and a recording member held on the first belt member, and that form a multi-superimposed image by superimposing the visible images, the image superimposing units being arranged at an equidistant pitch. The first driving roller satisfies a condition "$(R_2-R_1)\pi\times(ss-1)\times ps/(R_1\times\pi\times2)\leqq0.15$ millimeter", where $R_1$ is a diameter of the first driving roller under an environment of minimum temperature and minimum moisture in a use environment range designed, $R_2$ is a diameter of the first driving roller under an environment of maximum temperature and maximum moisture in the use environment range designed, ps is an arrangement pitch of the image superimposing units, ss is a total number of the image superimposing units, and $\pi$ is the circle ratio pi.

The other objects, features, and advantages of the present invention are specifically set forth in or will become apparent from the following detailed description of the invention when read in conjunction with the accompanying drawings.

DETAILED DESCRIPTION

Exemplary embodiments of the present invention will be explained in detail below with reference to the accompanying drawings.

Figure 1:
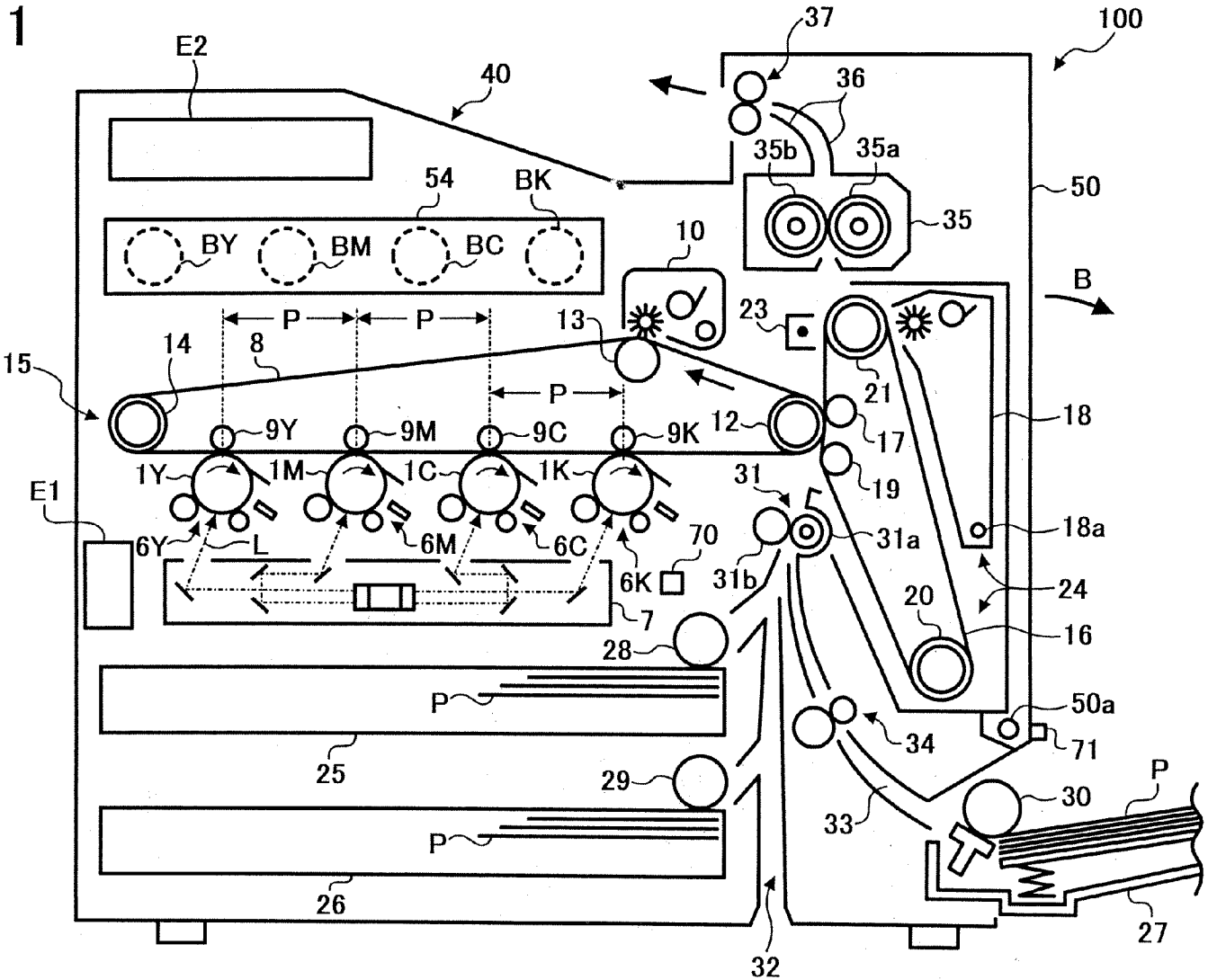
FIG. 1 is a front view of a configuration of a printer according to an embodiment.
Figure 2:
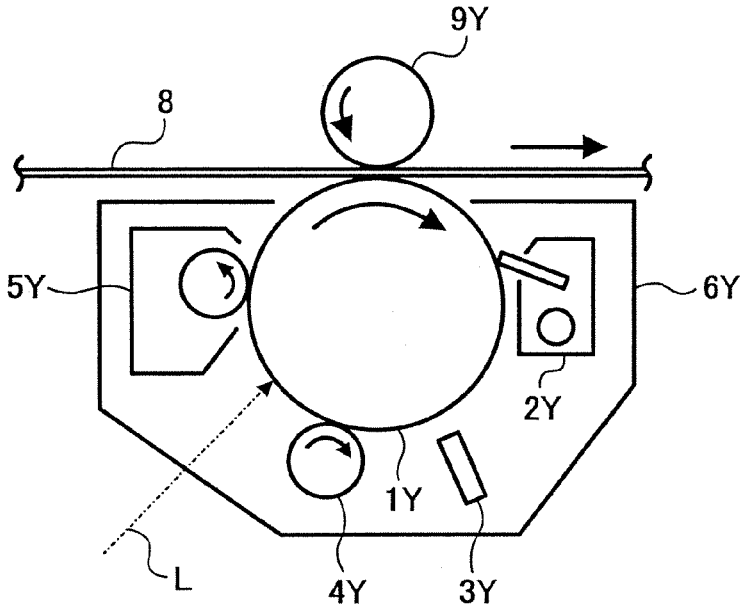
FIG. 2 is an enlarged view of a process cartridge for yellow color in the printer.

A basic configuration of the printer according to the present embodiment will be explained first. FIG. 1 is a front view of a configuration of the printer. In FIG. 1, a printer 100 includes four process cartridges 6Y, 6M, 6C, and 6K for producing toner images of yellow (Y), magenta (M), cyan (C), and black (B). The process cartridges use Y, M, C, and K toners, different in color from one another, as image forming substances, but they have identical configuration, and each process cartridge is replaced at the end of its life. FIG. 2 is an enlarged view of a process cartridge for yellow color. The process cartridge 6Y for producing a Y toner image includes a drum-like photoconductor 1Y serving as an image carrier, a drum cleaning device 2Y, a charge removing device 3Y, a charging device 4Y, a developing device 5Y, and the like. The photoconductor 1Y is an aluminum cylinder covered with a surface layer made from organic semiconductor, which is a photo-conductive material. The aluminum cylinder may be covered with an amorphous silicon base surface layer. The photoconductor may have a belt-like configuration instead of the drum-like configuration.

The charging device 4Y evenly charges the surface of the photoconductor 1Y that is rotated in a clockwise direction by a driving unit (not shown). The surface of the evenly charged photoconductor 1Y is exposed and scanned by a laser beam L to carry an electrostatic latent image for Y. The electrostatic latent image for Y is developed to a Y toner image by the developing device 5Y using Y toner. The Y toner image is primarily transferred on a first intermediate transfer belt 8. The drum cleaning device 2Y removes the remaining toner on the surface of the photoconductor 1Y that has been subjected to an intermediate transfer process. The charge removing device 3Y removes the remaining charge from the surface of the cleaned photoconductor 1Y. The surface of the photoconductor 1Y is initialized by the charge removal in preparation for formation of a next image. Similarly, in the other process cartridges 6M, 6C, and 6K, M, C, and K toner images are formed on the photoconductors 1M, 1C, and 1K respectively, and primarily transferred on the first intermediate transfer belt 8. In the present example, each developing device uses a two-component developing agent containing toner and magnetic carrier, but alternatively, the developing device may use only toner powder. Further, the toner may be toner particles produced by a crushing process, or toner particles formed in a spherical shape. Diameter of the toner particles is preferably about 6 micrometers (μm).

An exposing device 7 is arranged below the process cartridges 6Y, 6M, 6C, and 6K (see FIG. 1), and an image data processor E1 is arranged on the left side in FIG. 1. The image data processor E1 produces exposure scanning control signals based on image information signals transmitted by a personal computer or the like, and sends the control signals to the exposing device 7. Laser beams L are generated based on the exposure scanning control signals. The exposing device 7, which is a latent image forming unit, irradiates the laser beams L on the respective photoconductors in the process cartridges 6Y, 6M, 6C, and 6K. Electrostatic latent images for Y, M, C, and K are formed on the photoconductors 1Y, 1M, 1C, and 1K that are exposed by the beam irradiation. The exposing device 7 irradiates a laser beam (L) emitted from a light source to the photoconductor via a plurality of optical lenses and mirrors, while scanning the laser beam by a polygon mirror rotationally driven by a motor. Instead of the exposing device 7 with such a configuration, an exposing unit that irradiates light emitting diode (LED) light from an LED array may be adopted. A sealing member (not shown) is provided in a casing of the exposing device 7 in order to prevent internal parts of the exposing device 7 from being contaminated by toner dropping from the respective photoconductors 1Y, 1M, 1C, and 1K arranged above the exposing device 7.

The electrostatic latent images for Y, M, C, and K formed on the respective photoconductors 1Y, 1M, 1C, and 1K are subjected to a transfer process by a first transfer unit 15. The exposing device 7 is arranged below the first transfer unit 15, and a first sheet cassette 25 and a second sheet cassette 26 are arranged further below the exposing device 7. A manual feed tray 27 is arranged on the right side of the second sheet cassette 26.

A plurality of transfer papers P as recording members are stacked in each of the first sheet cassette 25 and the second sheet cassette 26. On the other hand, the manual feed tray 27 extends from a side wall of the casing instead of being provided inside the printer main unit, and transfer paper is stacked on an upper face of the manual feed tray 27.

In the printer 100, a sheet feeding system includes a first sheet feeding roller 28, a second sheet feeding roller 29, a manual sheet feeding roller 30, a resist roller pair 31, a sheet feeding path 32, a feeding sheet guiding path 33 joining to the sheet feeding path 32, a conveying roller pair 34, and the like. The first sheet feeding roller 28 and the second sheet feeding roller 29 come in pressure-contact with an uppermost transfer paper P in the first sheet cassette 25 and the second sheet cassette 26, respectively. The uppermost transfer paper P in each of the first sheet cassette 25 and the second sheet cassette 26 is fed toward the sheet feeding path 32 when a driving unit (not shown) drives a corresponding one of the first sheet feeding roller 28 and the second sheet feeding roller 29. The transfer paper P fed out is nipped between a first resist roller 31*a* and a second resist roller 31*b* of the resist roller pair 31 arranged near a terminal end of the sheet feeding path 32. Both the resist rollers 31*a* and 31*b* rotate in a forward direction relative to each other in order to nip the transfer paper P, but the rotation of both the rollers stops temporarily immediately after the rollers 31*a* and 31*b* nip the recording member. Rotation of both the rollers 31*a* and 31*b* restarts at a proper timing to feed the transfer paper P toward a secondary transfer nip. On the other hand, the manual sheet feeding roller 30 comes in pressure-contact with the uppermost transfer paper P placed on the manual feed tray 27. A driving unit (not shown) rotationally drives the manual sheet feeding roller 30 so that the uppermost transfer paper P is fed toward the feeding sheet guiding path 33. The transfer paper P fed out reaches a terminal end of the sheet feeding path 32 through rollers of the conveying roller pair 34 that are rotated in a forward direction relative to each other by a driving unit (not shown) while being brought in pressure-contact with each other. The transfer paper P is nipped between the first resist roller 31*a* and the second resist roller 31*b*.

The printer 100 is provided with a two-sided transfer device including the first transfer unit 15 and a second transfer unit 24. The first transfer unit 15 is arranged above the process cartridges 6Y, 6M, 6C, and 6K shown in FIG. 1, and has a belt device that moves the first intermediate transfer belt 8 endlessly. The belt device includes the first intermediate transfer belt 8, a driving roller 12 around which the first intermediate transfer belt 8 is spanned, a first cleaning backup roller 13, a tension roller 14, and the like. The first intermediate transfer belt 8 is endlessly moved in a counterclockwise direction in FIG. 1 by rotational driving of the driving roller 12. The first transfer unit 15 further includes four primary transfer rollers 9Y, 9M, 9C, and 9K arranged inside a belt loop, a first cleaning device 10 arranged outside the belt loop, and the like.

The first intermediate transfer belt 8 moved endlessly by the belt device is sandwiched between the four primary transfer rollers 9Y, 9M, 9C, and 9K and the photoconductors 1Y, 1M, 1C, and 1K to form primary transfer nips. A power supply (not shown) supplies power to the primary transfer rollers 9Y, 9M, 9C, and 9K receive to apply primary transfer bias reverse in polarity (e.g., positive polarity) to that of the toner, on a back face (an inner peripheral face of the belt loop) of the first intermediate transfer belt 8. The first intermediate transfer belt 8 is configured to satisfy an electric resistance condition that is suitable for realizing electrostatic transfer of toner images caused by the primary transfer biases. The respective process cartridges 6Y, 6M, 6C, and 6K, and the respective primary transfer rollers 9Y, 9M, 9C, and 9K as transfer units are arranged at equal pitch p.

The first intermediate transfer belt 8 sequentially passes through the primary transfer nips for Y, M, C, and K according to an endless movement thereof. Y, M, C, and K toner images on the photoconductors 1Y, 1M, 1C, and 1K are primarily transferred in a superimposing manner by the nip pressures and the primary transfer biases at the respective primary transfer nips. Thus, a four-color superimposed toner image (hereinafter, "a four-color toner image") is formed on the first intermediate transfer belt 8.

The driving roller 12, around which the first intermediate transfer belt 8 is spanned, is arranged and positioned so as to firmly push onto a second intermediate transfer belt 16. With such a firm-pushing arrangement, a secondary transfer nip is formed such that the first intermediate transfer belt 8 and the second intermediate transfer belt 16 are brought in pressure-contact with each other over a long range in circumferential directions of the transfer belts 8 and 16. The four-color toner image, which is a multi-superimposed image formed on the first intermediate transfer belt 8, is secondarily transferred on the second intermediate transfer belt 16 or a transfer paper P by the secondary transfer nip. Residual toner, which has not been transferred to the second intermediate transfer belt 16 or the transfer paper P, adheres on the first intermediate transfer belt 8 that has passed through the secondary transfer nip. The first cleaning device 10 cleans the residual toner. Specifically, the first intermediate transfer belt 8 is sandwiched between the first cleaning device 10 arranged in pressure-contact with an outer surface (an obverse face) of the first intermediate transfer belt 8 and the first cleaning backup roller 13 arranged on an inner surface of the first intermediate transfer belt 8. The first cleaning device 10 removes and cleans the residual toner on the obverse face mechanically or electrostatically. Instead of the four primary transfer rollers 9Y, 9M, 9C, and 9K adopting the bias applying system, rollers adopting a charger system that conducts discharging from an electrode may be used.

The second transfer unit 24 of the two-sided transfer device is arranged on the right side of the first transfer unit 15 as shown in FIG. 1, and includes the second intermediate transfer belt 16, a second cleaning device 18, a transfer charger 23, and the like. The second transfer unit 24 further includes a secondary transfer roller 17, a nip expanding roller 19, a tension roller 20, a backup roller 21, and the like. The second intermediate transfer belt 16 is endlessly moved in a clockwise direction in FIG. 1 according to rotational driving of at least one of the four rollers while being spanned around the four rollers. The secondary transfer roller 17 is made of metal or is covered with an electrically conductive rubber layer on a core metal, and a power source (not shown) supplies the secondary transfer roller 17 with a secondary transfer bias of polarity (for example, plus polarity) reverse to that of toner. All the rollers other than this secondary transfer roller 17 in the second transfer unit 24 are grounded.

The resist roller pair 31 in the sheet feeding system feeds the transfer paper P nipped between the rollers toward the secondary transfer nip at such a timing that the transfer paper P is brought in close contact with the four-color toner image primarily transferred on the first intermediate transfer belt 8.

If the four-color toner image is a first toner image to be transferred on a first face (an upward face on a stacking unit 40) of the transfer paper P, the transfer paper P is not fed out. Thus, at that time, the first toner image on the first intermediate transfer belt 8 is secondarily transferred on the second intermediate transfer belt 16 according to a nip pressure and a secondary transfer bias at the secondary transfer nip. On the other hand, if the four-color toner image on the first intermediate transfer belt 8 is a second toner image to be transferred on a second face (a downward face on the stacking unit 40) of the transfer paper P, the resist roller pair 31 feeds the transfer paper P in synchronization with the second toner image. Thus, the second toner image is secondarily transferred on the second face of the transfer paper P at the secondary transfer nip, so that a full color image is formed in combination with white color of the transfer paper P. At that time, the first toner image sandwiched between the first face of the transfer paper P and the second intermediate transfer belt 16 at the secondary transfer nip is attracted to the belt side owing to the secondary transfer bias. Therefore, the first toner image is brought in close contact with the first face of the transfer paper P, but is not secondarily transferred thereto. The second intermediate transfer belt 16 is set to an electric resistance condition suitable for realizing such electrostatic secondary transfer.

In the first transfer unit 15, the driving roller 12 spans the first intermediate transfer belt 8 so as to approximately reverse the moving direction of the first intermediate transfer belt 8. The secondary transfer nip is formed by bringing a portion of the first intermediate transfer belt 8, whose moving direction is being reversed, in pressure-contact with the second intermediate transfer belt 16. Therefore, the first intermediate transfer belt 8 is separated from the transfer paper P at an outlet of the secondary transfer nip, and the transfer paper P is conveyed while being retained on only the surface of the second intermediate transfer belt 16. The transfer paper P is fed to a third transfer section in the second transfer unit 24 according to endless movement of the second intermediate transfer belt 16. In the third transfer section in the second transfer unit 24, the transfer charger 23 is arranged at a predetermined distance opposite to a portion of the second intermediate transfer belt 16 that is spanned by the backup roller 21. The transfer charger 23 applies charge, having polarity (for example, positive polarity) reverse to that of the toner, to the second face of the transfer paper P on the second intermediate transfer belt 16. The first toner image sandwiched between the first face of the transfer paper P and the second intermediate transfer belt 16 is transferred a third time on the first face of the transfer paper P by applying charge, so that a full color image is formed. A transfer device 60 pre-transfers the second toner image on the second face of the transfer paper P at the secondary transfer nip, and thereafter, post-transfers the first toner image on the first face at the third transfer section. Instead of the rollers 19 and 17, other members such as brushes may be used as the members applied with the primary transfer bias or the secondary transfer bias. Instead of the electrostatic transfer system, a non-contact type discharging system may be adopted as the system for applying a transfer bias to the member.

In the second transfer unit 24, the transfer paper P whose two-sided transfer has been completed by the third transfer is separated from the second intermediate transfer belt 16, and fed to the fusing device 35. The second intermediate transfer belt 16 that has passed through the third transfer section is sandwiched between the backup roller 21 and the second cleaning device 18, so that the residual toner on the surface of the second intermediate transfer belt 16 after transfer is mechanically or electrostatically cleaned. If the second cleaning device 18 is always brought in pressure-contact with the second intermediate transfer belt 16, the first toner image secondarily transferred on the second intermediate transfer belt 16 is also cleaned. Therefore, the second cleaning device 18 is swung about a swinging shaft 18*a* in a direction of an arrow shown in FIG. 1 by a swinging mechanism (not shown), to move towards and away from the second intermediate transfer belt 16. The second cleaning device 18 is separated from the second intermediate transfer belt 16 at least for a duration while the first toner image passes through the cleaning position, so that the first toner image is not cleaned.

The fusing device 35 serving as a fixing unit is arranged above the second transfer unit 24, as shown in FIG. 1. The fusing device 35 has two fusing rollers 35*a* and 35*b* that are brought in pressure-contact with each other while being rotated in forward directions toward each other to form a fusing nip. The fusing rollers 35*a* and 35*b* have heat generating units such as halogen lamps (not shown), and heat the transfer paper P, which is sandwiched in the fusing nips, on both sides. The full color images formed on both the faces of the transfer paper P, are fused on the transfer paper P by softening of the toner forming the image. Next, the transfer paper P onto which the images are fused is reversed along a reversing guide member 36, and is discharged outside the apparatus via a sheet discharging roller pair 37. The transfer paper P is stacked on the stacking unit 40 that is provided on an upper face of the casing of the printer main unit.

As described above, the printer 100 transfers four-color toner images, which are precursors of full color images, on both faces of a transfer paper P by the two-sided transfer unit before feeding the transfer paper P to the fusing device 35 that performs fusing process of the full color images. Thus, image formation can be performed on both the faces of the transfer paper P in a one-path system. In the printer 100, the first transfer unit 15, having the belt device and the primary transfer rollers 9Y, 9M, 9C, and 9K that are a plurality of transfer units and that are arranged at an equal pitch p inside the loop of the first intermediate transfer belt 8, functions as an image superimposing unit that superimposes visible images carried on the respective photoconductors on the obverse face of the first intermediate transfer belt 8.

A bottle housing unit 54 is arranged above the first transfer unit 15, as shown in FIG. 1. Toner bottles BY, BM, BC, and BK containing toners to be replenished to the developing devices in the respective process cartridges 6Y, 6M, 6C, and 6K are placed in the bottle housing unit 54.

The printer 100 is a system in which a plurality of image carriers such as photoconductors are arranged in series, and respective visible images formed are continuously transferred in a superimposing manner to form a multi-interposed image, and is called "a tandem system". On the other hand, a single system in which, after forming a visible image on an image carrier to transfer the visible image onto an intermediate transfer member, a step of forming another visible image on the image carrier again to transfer the same onto the intermediate transfer member in a superimposing manner is repeated. The single system has an advantage as compared with the tandem system in that the whole apparatus can be made compact and cost reduces, because only one image carrier is provided. However, the single system has a disadvantage that it is difficult to shorten the time for an image forming process, because a step of forming and transferring a visible image is repeated by rotating the intermediate transfer belt several times. On the other hand, the tandem system has a disadvantage that it is difficult to reduce the size and the cost of the apparatus because a plurality of image carriers must be provided, but it has an advantage that the time for the image forming process can be reduced because respective color images can be formed substantially in parallel. The tandem system is drawing attention because demand for speedy output of a full color image compared to that of a monochromic image is on the rise.

The tandem system is roughly classified into a direct transfer tandem system that directly transfers visible images on respective image carriers to a transfer paper, and an indirect transfer tandem system that transfers visible images on respective image carriers to a transfer paper via an intermediate transfer belt. The direct transfer tandem system must have a sheet cassette or a fusing device arranged just beside a cartridge group, which includes a plurality of process cartridges arranged to thread a transfer paper straight toward the cartridge group, in order to suppress jamming of the transfer paper. However, this results in a drawback that size of the apparatus increases along a transfer paper conveying direction. Moreover, exclusive cartridge groups corresponding to an obverse face and a back face of a transfer paper are required in order to achieve a one pass two-sided transfer by the direct transfer tandem system, and hence, the problem about the size increase of the apparatus becomes further serious. On the other hand, the indirect transfer tandem system does not require such a countermeasure that a sheet cassette or a fusing device be arranged just beside the cartridge group around the intermediate transfer belt in order to suppress jamming. Also, it is possible to provide a path extending from sheet feeding to fusing at any position around the intermediate transfer belt. Therefore, in the indirect transfer tandem system, there is an advantage that the size increase of the apparatus along the transfer paper conveying direction can be avoided. By adopting such a system like the printer 100, in which a multi-superimposed image obtained by superimposing visible images on the first intermediate transfer belt is transferred on the second intermediate transfer belt, it is unnecessary to provide the cartridge groups corresponding to an obverse face and a back face of the transfer paper, respectively. Therefore, the indirect tandem system is recently drawing attention.

As described above, the first toner image is formed before formation of the second toner image. After being secondarily transferred from the first intermediate transfer belt 8 to the second intermediate transfer belt 16 at the secondary transfer nip, the first toner image is transferred a third time on the first face of the transfer paper P at the third transfer section. The first face is directed upward on the stacking unit 40. Therefore, transfer papers P to be stacked on the stacking unit 40 are sequentially stacked in a state that first toner images formed ahead face upward, and second toner images formed thereafter face downward. When the printer 100 forms images with two continuous page numbers such as an odd number and an even number, an image with a larger page number is formed as the first toner image ahead in order to arrange page numbers of the transfer papers P thus stacked in an ascending order. For example, an image on the second page is formed as the first toner image ahead of an image on the first page. Thus, even when several-page documents are continuously output, the page numbers can be arranged in an ascending order in the stacking unit 40. When a simplex print mode is performed for forming an image on a second face of a transfer paper P, images are formed in an ascending order of page numbers, and the respective images are secondarily transferred on second pages of respective transfer papers P. Thus, the page numbers are arranged in an ascending order in the stacking unit 40 even in a simplex print mode.

In the four photoconductors 1Y, 1M, 1C, and 1K, respective color toner images formed for the second toner images are formed as non-mirror images (hereinafter, "normal images"). This is because respective color toner images formed are changed from mirror images to normal images in the course of arrival at the transfer paper P via two transfer processes, the primary transfer process and the secondary transfer process. Formation as normal images on the respective photoconductors results in normal images even on the second face of the transfer paper P. On the other hand, for the first toner images, because three transfer processes up to the third transfer are performed on respective color toner images formed, the number of transfer processes is larger than that for the second toner images by one. Therefore, the respective color toner images formed for the first toner images can be formed on the respective photoconductors as mirror images. Thus, for each of the transfer processes, an image obtained changes from a normal image to a mirror image and then to a normal image, which results in a normal image on the first face of the transfer paper P.

Figure 3:
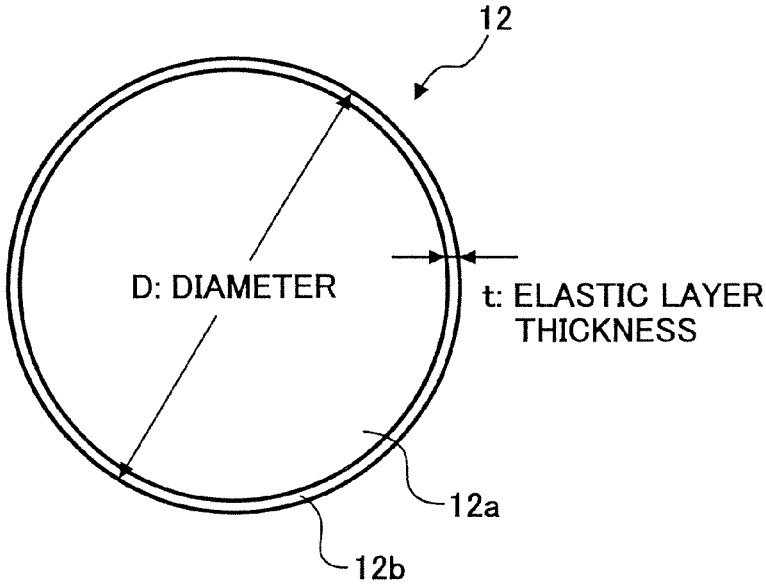
FIG. 3 is a cross-section of a driving roller in the printer.

FIG. 3 is a cross-section of the driving roller 12. In the printer 100, a roller, which includes a roller core metal 12*a* serving as a roller core member, and a surface layer 12*b* made from an elastic material such as ethylene propylene (EP) rubber provided on a surface of the roller core metal 12*a*, is used as the driving roller 12. In the driving roller 12 with such a configuration, thickness of the surface layer 12*b* fluctuates according to the environmental fluctuation, and consequently, roller diameter also fluctuates. A diameter of the driving roller 12 changes not only due to a change in the thickness of the surface layer 12*b* according to the environmental fluctuation, but also due to a change in the diameter of the roller core metal 12*a* that is caused by the environmental fluctuation. However, the latter cause of change in diameter is negligible in a use temperature range designed. Therefore, it is assumed that the change in the diameter of the driving roller 12 occurs due to only the change in thickness of the surface layer 12*b* according to the environmental fluctuation, in the use temperature range designed.

In the present invention, the term "use environment range designed" refers to a use environment range of an apparatus determined at a designing time of the apparatus. The "use environment range designed" is described in an instruction manual as a recommended temperature range or a recommended moisture range for using the apparatus, or is notified by a manufacturer or a seller of the apparatus via electronic data, or orally.

In the printer 100, the minimum temperature in the use environment range designed is set to 10° C. The minimum moisture in the use environment range is set to 15%. The maximum temperature in the use environment range is set to 35° C. The maximum moisture in the use environment range is set to 80%. The pitch p (=image superimposing unit arrangement pitch=a transfer unit arrangement pitch) shown in FIG. 1 is set to 26.2π millimeters (mm).

A characteristic configuration of the printer 100 is explained next.

The inventor performed two experiments. A first experiment was performed using a test model having a configuration similar to that of the printer 100. That is, a roller with a driving roller diameter $R_1$ of 26.2 mm and a surface layer minimum thickness t of 0.5 mm under an environment (temperature of 22.5° C. and moisture of 47.5%) of the minimum temperature and the minimum moisture in the use environment range was set as the driving roller 12. A four-color toner image was formed under a condition of a temperature of 10° C. and moisture of 15% that are the minimum temperature and the minimum moisture in the use environment range designed. Superimposing deviation among respective color toner images on the first intermediate transfer belt 8 were then measured. Based on these measurements, light-writing start timings to respective photoconductors were corrected to such timings that no superimposing deviation occurs. After confirming that no superimposing deviation occurs according to the correction, the temperature was changed from 10° C. to 35° C., which is the maximum temperature in the use environment range, while the moisture was maintained at 15%. Four-color toner images were formed after 0 minute, 5 minutes, 20 minutes, 60 minutes, 240 minutes, and 480 minutes elapsed from the change, and the superimposing deviation was measured for each of the respective four-color toner images. The superimposing deviation increased till elapse of 240 minutes, but change of the superimposing deviation over time could not be confirmed after elapse of 240 minutes. The superimposing deviation of the four-color toner image formed after elapse of 240 minutes was 0.118 mm.

The second experiment was performed using the test model of the printer 100. That is, after performing the first experiment, light-writing start timings to respective photoconductors were corrected to such timings that no superimposing deviation occur, based on the measurement the superimposing deviation of all the respective color toner images on the first intermediate transfer belt 8. The moisture was then changed from 15% to 80%, which is the maximum moisture in the use environment range, while the temperature was maintained at 35° C. Four-color toner images were formed after 0 minute, 5 minutes, 20 minutes, 60 minutes, 240 minutes, and 480 minutes elapsed from the change, and the superimposing deviation was measured for all the respective four-color toner images. The superimposing deviation increased till elapse of 240 minutes, but change of the superimposing deviation with time could not be confirmed after elapse of 240 minutes. The superimposing deviation of the four-color toner image formed after elapse of 240 minutes was 0.014 mm.

Figure 4:
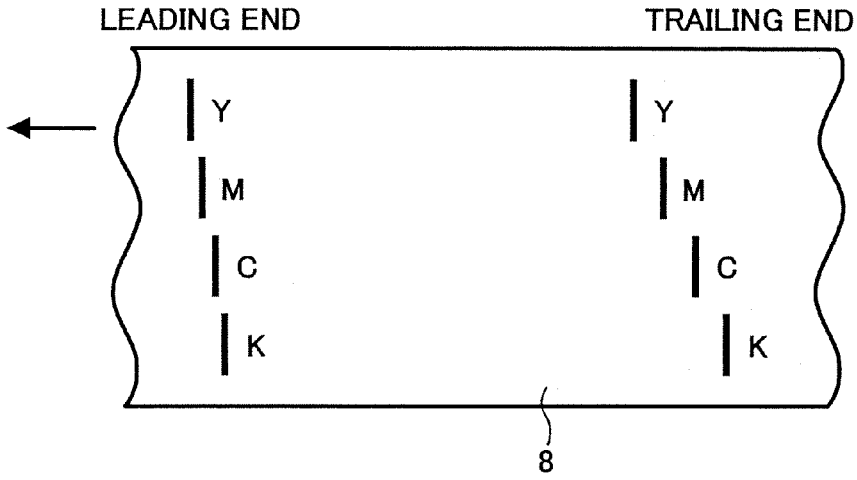
FIG. 4 illustrates a four-color toner image formed on a surface of a first intermediate transfer belt in the printer.

From the results of the two experiments, it was found that the superimposing deviation obtained when the temperature and the moisture are sharply changed from 10° C. and 15% to 35° C. and 80% was 0.132 (0.118+0.014) mm. This value is less than the target value 0.15 mm. At that time, the superimposing deviation positioned on a leading end side of an image became larger than that positioned on a trailing end side thereof, as shown in FIG. 4. Further, the later the superimposing order became, the larger the superimposing deviation became toward a downstream side in the moving direction of the belt. In the above experiments, a roller having a surface layer thickness of 0.1 mm was used as the driving roller. When an experiment was conducted using a roller having a surface layer thickness of 0.2 mm, the positional deviation became 0.26 mm, about double the above value, which resulted in drastic degradation in the image quality.

In the present invention, the superimposing deviation of visible images occurring according to an environmental fluctuation can be expressed by an equation (1)

$$\text{deviation}=A\times B \tag{1}$$

where A is a belt positional deviation per rotation of the driving roller, and B is the number of rotations of the driving roller from start to end of superimposing. The belt positional deviation per rotation of the driving roller A can be expressed by an equation (2)

$$A=(D-C)\pi \tag{2}$$

where C is a driving roller diameter before change, and D is the driving roller diameter after change. The number of rotations of the driving roller from the start to the end of superimposing B can be expressed by an equation (3)

$$B=E/C\pi \tag{3}$$

where E is a length of the belt moved from the start to the end of superimposing. The length of the belt moved from the start to the end of superimposing E can be expressed by equation (4)

$$E=(s-1)\times p \tag{4}$$

where s is a total number of image superimposing units, and p is an arrangement pitch of image superimposing units. Substituting the equations (2), (3), and (4) in the equation (1), the superimposing deviation of visible images occurring due to an environmental fluctuation can be expressed by an equation (5).

$$\text{deviation}=(D-C)\pi\times(s-1)\times p/C\pi \tag{5}$$

When the image superimposing unit is a transfer device, the total number of image superimposing units s corresponds to the total number of transfer devices, and the arrangement pitch of image superimposing units p corresponds to an arrangement pitch of the transfer devices. When the environment becomes the minimum temperature and the minimum moisture in the use environment range designed, the diameter of the driving roller becomes the minimum driving roller diameter $R_1$. On the contrary, when the environment in the use environment range designed becomes the maximum temperature and the maximum moisture, the diameter of the driving roller becomes the maximum driving roller diameter $R_2$. Therefore, when the environment sharply changes from the minimum temperature and the minimum moisture to the maximum temperature and the maximum moisture, the parameters C and D in equation (5) become $R_1$ and $R_2$, respectively, so that the superimposing deviation of visible images is expressed by an equation (6).

$$\text{deviation}=(R_2-R_1)\pi\times(s-1)\times p/(R_1\times\pi) \tag{6}$$

In this case, the velocity of the moving belt under the environment of the maximum temperature and the maximum moisture becomes remarkably faster than that under the environment of the minimum temperature and the minimum moisture. Therefore, a visible image that occurs later in the superimposing order deviates from its original superimposing position to a further downstream side. On the contrary, when the environment sharply changes from the maximum temperature and the maximum moisture to the minimum temperature and the minimum moisture, the superimposing deviation of visible images becomes the value obtained from equation (6). In this case, a visible image that occurs later in the superimposing order deviates from its original superimposing position to a further upstream side. However, such a sharp change in the environment, from the minimum temperature and the minimum moisture to the maximum temperature and the maximum moisture or vice-versa, rarely occurs. This is because, the user most likely uses the apparatus under at an intermediate temperature and intermediate moisture in the use environment range designed, and the environment generally changes from about the intermediate temperature and the intermediate moisture to a lower temperature and lower moisture, or a higher temperature and higher moisture. Therefore, the maximum value of the actual superimposing deviation of visible images becomes almost a half of the value obtained from equation (6). This value becomes the value of an equation obtained by substituting "$p/(R_1\times\pi\times2)$" for "$p/(R_1\times\pi)$" in equation (6). That is, the maximum value of the actual superimposing deviation of visible images can be approximately expressed by an equation (7).

$$\text{deviation}=(R_2-R_1)\pi\times(s-1)\times p/(R_1\times\pi\times2) \quad (7)$$

Thus, by using a roller, for which the value obtained from the equation (7) is in an allowable range of the superimposing deviation, as the driving roller, image disturbance due to superimposing deviation among respective visible images can be suppressed without depending on the deviation correcting control.

When a roller provided with the surface layer 12*b* made from an elastic material is used as the driving roller 12 like that in the printer 100, the equation (7) can be transformed by replacing $(R_2-R_1)\pi$ with "$(k\times t\times2)\pi$" to obtain an equation (8)

$$\text{deviation}=(k\times t\times2)\pi\times(s-1)\times p/(R_1\times\pi\times2) \quad (8)$$

where k is an expansion coefficient, and t is a surface layer minimum thickness. The expansion coefficient k in the equation (8) is a change in thickness per unit thickness of the surface layer 12*b* occurring when an environment changes from the minimum temperature and the minimum moisture to the maximum temperature and the maximum moisture in the use environment range. In the test model, the expansion coefficient k is a change in thickness per unit thickness of the surface layer 12*b* when the environment changes from a temperature of 10° C. and moisture of 15% to a temperature of 35° C. and moisture of 80%. The surface layer minimum thickness t is a thickness of the surface layer 12*b* under the environment of the minimum temperature and the minimum moisture. In the test model, the surface layer minimum thickness t is 0.5 mm. The product of the expansion coefficient k and the surface layer minimum thickness t is multiplied by 2, because a thickness corresponding to two layers of the surface layer 12*b* is included in the diameter of the driving roller 12.

By measuring the expansion coefficient k utilizing one roller, the driving roller diameter or the surface layer thickness required for achieving a target value for the positional deviation can be estimated according to the above conversion using the equation (8). A design can be reasonably made instead of depending on experiences like in the conventional technique. Even when material for the surface layer of the driving roller is changed, the number of design steps can be reduced remarkably. In the experiment, because a driving roller with a diameter of 26.2 mm and a surface layer thickness of 0.5 mm was used, and an arrangement pitch of the image superimposing units was set to 26.2 mm, the expansion coefficient k obtained by substitution of these values was 0.014. By substituting this value of the expansion coefficient k in the equation (8), an equation (9) can be obtained $$\text{deviation}=(0.028\times t)\pi\times(s-1)\times p/(R_1\times\pi\times2) \quad (9)$$

As described above, when the superimposing deviation of four-color toner images begins to exceed 0.15 mm, the number of complaints from users, of image disturbance due to superimposing deviation being conspicuous, rises sharply. In the printer 100 according to the embodiment, a roller that can suppress the value of the equation (9) to 0.15 mm or less is used as the driving roller 12. With such a configuration, the disturbance on the four-color toner image due to superimposing deviation among the respective color toner images can be suppressed without depending on the deviation correcting control.

The superimposing deviation also occurs due to causes other than the change of the driving roller diameter. For example, the superimposing deviation also occurs due to change of the circumferential length of the first intermediate transfer belt 8 due to environmental fluctuation. Further, for example, when a transfer device such as the first transfer unit 15 in the printer 100 is used as the image superimposing unit instead of employing a unit of a direct recording system as described in Japanese Patent Application Laid-Open No. 2000-94734, a superimposing deviation due to a circumferential velocity error of the photoconductor also occurs. The inventor has experientially found that of the superimposing deviation (the total deviation) actually occurring in the configuration using the transfer device, the superimposing deviation due to a change in the driving roller diameter is about ⅓ of the total deviation. Therefore, when the transfer device is used as the image superimposing unit like in the printer 100, it is desirable that the value of the equation (9) be suppressed to 0.05 mm or less, which is ⅓ of 0.15 mm.

When the value of the equation (9) is suppressed to 0.15 mm or less, the value of the equation (7) is necessarily suppressed to 0.15 mm or less. When the value of the equation (9) is suppressed to 0.05 mm or less, the value of the equation (7) is also necessarily suppressed to 0.05 mm or less.

As described above, the superimposing deviation also occurs due to change in the circumferential length of the first intermediate transfer belt 8 according to an environmental fluctuation. In the printer 100, therefore, a belt having a belt base member made from polyimide or polyamide-imide is used as the first intermediate transfer belt 8. If the belt member has a single-layered structure, the belt base member described here refers to the belt member itself. If the belt member has a multi-layered structure, the belt base member described here refers to the thickest layer of respective layers. Polyimide or polyamide-imide is a material in which expansion and contraction due to environmental fluctuation is considerably low. Therefore, if the belt base member of the first intermediate transfer belt 8 is made of polyimide or polyamide-imide, image disturbance due to the superimposing deviation can be suppressed further reliably.

Figure 5:
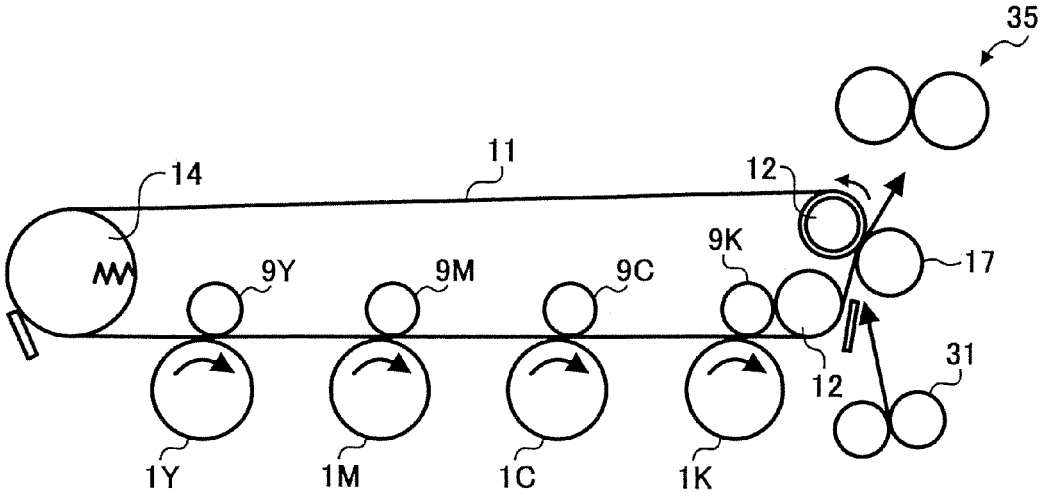
FIG. 5 illustrates a configuration of relevant parts of a modified example of the printer.

FIG. 5 illustrates a configuration of relevant parts of a modified example of the printer 100. The modified apparatus is configured to form a four-color toner image on only a first face of a transfer paper and not on both faces thereof, and a device that moves an intermediate transfer belt 11 endlessly via the driving roller 12 is used as the transfer device. In the modified apparatus, a four-color toner image on a first intermediate transfer belt is not transferred on a second intermediate transfer belt for realizing two-sided transfer in one pass system, however, only the intermediate transfer belt 11 is used as the intermediate transfer member. In the modified apparatus, a transfer paper is fed through the resist roller pair 31 to a secondary transfer nip, which is a pressure-contacting portion of the intermediate transfer belt 11 and the secondary transfer roller 17. A four-color toner image on the intermediate transfer belt 11 is secondarily transferred on a first face of the transfer paper fed. The transfer paper brought in close contact with the intermediate transfer belt 11 at the secondary transfer nip must be separated from the intermediate transfer belt 11, and fed to the fusing device 35.

In the modified apparatus, a curvature separation by a separating roller is adopted as a system for separating a transfer paper from the intermediate transfer belt 11, and the driving roller 12 also serves as the separating roller. In the curvature separation, a moving direction of a belt member is sharply changed at a position where the belt member turns over the separating roller, which has a small diameter and on which the belt member is spanned. The transfer paper cannot follow the sharp change, and thus separates from the belt member. Utilizing the driving roller 12 as the separating roller avoids an increase in cost of providing a separating roller in addition to the driving roller 12.

The printer in which a transfer device such as the first transfer unit 15 is used as the image superimposing unit is explained above, but the present invention can be applied to an image forming apparatus using an image superimposing unit adopting a direct recording system, such as that described in Japanese Patent Application Laid-Open No. 2000-94734.

A roller that satisfies a condition $$(R_2-R_1)\pi\times(s-1)\times p/(R_1\times\pi\times 2)\leqq 0.05\text{ mm} \quad (10)$$

is used as the driving roller 12. Consequently, of the total deviation, the deviation due to change in the driving roller diameter can be suppressed to 0.05 mm or less. Thus, if the transfer device is used as the image superimposing unit, disturbance of a four-color toner image due to superimposing transfer deviation among respective color toner images can be suppressed reliably.

If a roller in which the surface layer 12*b*, made from elastic material such as EP rubber, is provided on the roller core metal 12*a* serving as the roller core material, and that satisfies a condition $$(k\times t\times 2)\pi\times(s-1)\times p/(R_1\times\pi\times 2)\leqq 0.05\text{ mm} \quad (11)$$

is used as the driving roller 12, the following effect can be obtained. That is, with such a configuration, the roller necessarily satisfies the condition (10) explained above. Accordingly, disturbance of a four-color toner image due to superimposing transfer deviation among respective color toner images can be suppressed reliably in the configuration when the transfer device is used as the image superimposing unit.

By using a roller that satisfies a condition $$(0.028\times t)\pi\times(s-1)\times p/(R_1\times\pi\times 2)\leqq 0.05\text{ mm} \quad (12)$$

as the driving roller 12, the following effect can be obtained. That is, the numerical value "0.028" in the condition (12) is double of 0.014, which is the expansion coefficient k obtained when a layer made from EP rubber is used as the surface layer 12*b*, and corresponds to "k×2" in "(k×t×2)". Thus, if the transfer device is used as the image superimposing unit, and a surface layer made from EP rubber is used as the surface layer 12*b*, disturbance of a four-color toner image due to superimposing transfer deviation among respective color toner images can be suppressed reliably.

In the modified apparatus, the device that superimposes respective color toner images on a transfer paper held on a surface of the intermediate transfer belt 11 serving as the belt member is used as the transfer device serving as the image superimposing unit, and a transfer paper on which a four-color toner image, which is a multi-superimposed image, has been formed, is separated from the intermediate transfer belt 11 at a portion of the intermediate transfer belt 11 wound on the driving roller 12. That is, the driving roller 12 also serves as the separating roller. Such a configuration avoids an increase in cost of providing a separating roller in addition to the driving roller 12.

Therefore, in the printer 100 according to the embodiment, because a belt member having a belt base member made from polyimide or polyamide-imide is used as the first intermediate transfer belt, image disturbance due to the superimposing deviation can be further suppressed reliably.

The present inventor has found from experience that, when the superimposing deviation of visible images begins to exceed 0.15 mm, there is a sharp rise in image degradation due to superimposing deviation.

According to the present invention, it is possible to suppress image disturbance due to superimposing deviation among respective visible images without depending on the deviation correcting control, by suppressing the value of the equation (7) to 0.15 mm or less.

It is desirable to suppress the deviation expressed by the equation (7) to 0.05 mm or less, which is ⅓ of 0.15 mm, because there are various fluctuation factors other than the driving roller diameter. By examination conducted by the inventor, complaints about image quality from users are eliminated completely.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a belt device that moves a belt member endlessly by rotating a driving roller while the belt member is spanned by spanning members, wherein the driving roller is one of a plurality of the spanning members; and a plurality of transfer units that transfer in a superimposing manner, visible images carried on corresponding image carriers, onto any one of an obverse face of the belt member and a recording member held on the belt member, wherein the transfer units are arranged inside a loop of the belt member, each the transfer unit being placed opposite to one of a plurality of the image carriers that are arranged equidistantly outside the loop of the belt member, and at a pitch identical to a pitch at which the image carriers are arranged, wherein the driving roller satisfies a condition "(R4-R3)π×(st−1)×pt/(R3×π×2)≦0.15 millimeter", where R3 is a diameter of the driving roller under an environment of minimum temperature and minimum moisture in a use environment range designed, R4 is a diameter of the driving roller under an environment of maximum temperature and maximum moisture in the use environment range designed, pt is an arrangement pitch of the transfer units, st is a total number of the transfer units, and π is the circle ratio pi.

2. An image forming apparatus comprising:

a first belt device that moves a first belt member endlessly by rotating a first driving roller while the first belt member is spanned by first spanning members, wherein the first driving roller is one of a plurality of the first spanning members; and a plurality of image superimposing units that superimpose visible images onto any one of an obverse face of the first belt member and a recording member held on the first belt member, and that form a multi-superimposed image by superimposing the visible images, the image superimposing units being arranged at an equidistant pitch, wherein the first driving roller satisfies a condition "$(R_2-R_1)\pi\times(ss-1)\times ps/(R_1\times\pi\times 2)\leqq 0.15$ millimeter", where $R_1$ is a diameter of the first driving roller under an environment of minimum temperature and minimum moisture in a use environment range designed, $R_2$ is a diameter of the first driving roller under an environment of maximum temperature and maximum moisture in the use environment range designed, ps is an arrangement pitch of the image superimposing units, ss is a total number of the image superimposing units, and $\pi$ is the circle ratio pi.

3. The image forming apparatus according to claim 2, wherein the image superimposing unit is a transfer device that includes a second belt device that moves a second belt member endlessly by rotating a second driving roller while the second belt member is spanned by second spanning members, wherein the second driving roller is one of a plurality of the second spanning members; and a plurality of transfer units that transfer in a superimposing manner, visible images carried on corresponding image carriers, onto any one of an obverse face of the second belt member and a recording member held on the second belt member, wherein the transfer units are arranged inside a loop of the second belt member, each the transfer unit being placed opposite to one of a plurality of the image carriers that are arranged equidistantly outside the loop of the second belt member, and at a pitch identical to a pitch at which the image carriers are arranged, wherein the second driving roller satisfies the condition "$(R4-R3)\pi\times(st-1)\times pt/(R3\times\pi\times 2)\leqq 0.15$ millimeter", where R3 is a diameter of the second driving roller under an environment of minimum temperature and minimum moisture in a use environment range designed, and R4 is a diameter of the second driving roller under an environment of maximum temperature and maximum moisture in the use environment range designed, pt is an arrangement pitch of the transfer units, st is a total number of the transfer units.

4. The image forming apparatus according to claim 3, wherein the second driving roller includes a roller core member having a surface layer made of elastic material, and the second driving roller satisfies a condition "$(k\times t\times 2)\pi\times(st-1)\times pt/(R3\times\pi 2)\leqq 0.15$ millimeter", wherein k is an expansion coefficient, which is a change in thickness per unit thickness of the surface layer occurring when the environment changes from the minimum temperature and the minimum moisture to the maximum temperature and the maximum moisture, and t is a surface layer minimum thickness, which is a thickness of the surface layer under the environment of the minimum temperature and the minimum moisture.

5. The image forming apparatus according to claim 4, wherein the second driving roller satisfies a condition "$(0.028\times t)\pi\times(st-1)\times pt/(R3\times\pi\times 2)\leqq 0.15$ millimeter".

6. The image forming apparatus according to claim 3, wherein the second belt member is made of any one of polyimide and polyamide-imide.

7. The image forming apparatus according to claim 2, wherein the first driving roller includes a roller core member having a surface layer made of elastic material, and the first driving roller satisfies a condition "$(k\times t\times 2)\pi\times(ss-1)\times ps/(R_1\times\pi\times 2)\leqq 0.15$ millimeter", where k is an expansion coefficient, which is a change in thickness per unit thickness of the surface layer occurring when the environment changes from the minimum temperature and the minimum moisture to the maximum temperature and the maximum moisture, and t is a surface layer minimum thickness, which is a thickness of the surface layer under the environment of the minimum temperature and the minimum moisture.

8. The image forming apparatus according to claim 7, wherein the first driving roller satisfies a condition "$(0.028\times t)\pi\times(ss-1)\times ps/(R_1\times\pi\times 2)\leqq 0.15$ millimeter".

9. The image forming apparatus according to claim 2, wherein the image superimposing unit superimposes the visible images on the recording member held on a surface of the first belt member, and the recording member, with the multi-superimposed image formed thereon, is separated from the first belt member at a portion of the first belt member that is wound around the first driving roller.

* * * * *